US006583683B2

(12) United States Patent
Schubert et al.

(10) Patent No.: US 6,583,683 B2
(45) Date of Patent: Jun. 24, 2003

(54) DEVICE FOR ROTATING THE POLARIZATION OF AN ELECTROMAGNETIC WAVE AT THE EXIT FROM A WAVEGUIDE, AND A CORRESPONDING SYSTEM

(75) Inventors: Jean-Denis Schubert, Verneuil sur Seine (FR); Marc Sauvage, Houilles (FR); Robert Le Roux, Asnieres (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/893,489

(22) Filed: Jun. 29, 2001

(65) Prior Publication Data

US 2002/0000892 A1 Jan. 3, 2002

(30) Foreign Application Priority Data

Jun. 30, 2000 (EP) ..... 00 400 194

(51) Int. Cl.[7] ..... H01P 1/17
(52) U.S. Cl. ..... 333/21 A; 333/135; 333/208
(58) Field of Search ..... 333/21 A, 135, 333/208

(56) References Cited

U.S. PATENT DOCUMENTS 2,434,645 A 1/1948 Fox
2,754,483 A 7/1956 Zaleski
3,715,688 A * 2/1973 Woodward ..... 333/1
4,816,786 A * 3/1989 Mohring ..... 333/125
4,837,531 A * 6/1989 Gourlain et al. ..... 333/135
4,849,720 A * 7/1989 Call ..... 333/125

OTHER PUBLICATIONS

B. N. Das et al, "Narrow Wall Axial –Slot–Coupled T Junction Between Rectangular and Circular Waveguides", IEEE Transactions on Microwave Theory and Techniques, IEEE, Inc. New York, vol. 37, No. 10 Oct. 1, 1989 pp. 1590–1596 XP000051780.

Patent Abstracts of Japan, vol. 3, No. 119 (E–142) Oct. 6, 1979 corresponding to JP 54 097348 (Nippon Denki K.K.) dated Aug. 1, 1979.

* cited by examiner

*Primary Examiner*—Michael Tokar
*Assistant Examiner*—Vibol Tan
(74) *Attorney, Agent, or Firm*—Sughrue Mion, PLLC

(57) ABSTRACT

The invention relates to a device for rotating through a predefined angle the polarization of a polarized electromagnetic wave propagating in a first waveguide. According to the invention, the device comprises a second waveguide having a lateral port, the polarized electromagnetic wave propagates between a port of the first waveguide and the lateral port of the second waveguide via a coupling orifice that is smaller than the cross-section of the first waveguide and whose geometry is adapted to provide electromagnetic coupling between the first waveguide and the second waveguide, and the other port of the second waveguide is on a face perpendicular to the lateral port.

10 Claims, 5 Drawing Sheets

DEVICE FOR ROTATING THE POLARIZATION OF AN ELECTROMAGNETIC WAVE AT THE EXIT FROM A WAVEGUIDE, AND A CORRESPONDING SYSTEM

BACKGROUND OF THE INVENTION

The present invention relates to a device for rotating the polarization of a polarized electromagnetic wave at the exit from a waveguide. The device can be used in particular in a radiocommunications transceiver.

The polarization of an electromagnetic wave at the exit from a waveguide is usually rotated by means of a twist. FIG. 1 shows a twist known in the art. A twist TW is butt-jointed to the exit of a rectangular waveguide GO. The twist TW takes the form a rectangular section waveguide which is twisted about its longitudinal axis AL so that its entry cross-section S1 and its exit cross-section S2 are at a predefined angle $\alpha$ to each other which is equal to the required rotation angle. The entry cross-section of the twist S1 has the same dimensions as the cross-section of the waveguide GO.

One disadvantage of using a twist to rotate the polarization at the exit from a waveguide is the relatively large amount of space required to use a twist. It is generally necessary to integrate several twists into a radiocommunications transceiver unit. For example, there is one twist between the transmitter and the antenna, another between the receiver and the antenna and a third between the transmitter and the receiver. This rules out the production of a compact transceiver unit.

An object of the present invention is to remedy this disadvantage by proposing a device using the effects of electromagnetic coupling at the interface between the exit from a waveguide and the device of the invention. This coupling is obtained by geometrical characteristics of the interface between the device and the exit from the waveguide. It enables the polarization of an electromagnetic wave to be rotated without using a twist.

SUMMARY OF THE INVENTION

This object, together with others that become apparent hereinafter, is achieved by a device for rotating through a predefined angle the polarization of a polarized electromagnetic wave propagating in a first waveguide. The device comprises a second waveguide having a lateral port, the polarized electromagnetic wave propagates between a port of the first waveguide and the lateral port of the second waveguide via a coupling orifice that is smaller than the cross-section of the first waveguide and whose geometry is adapted to provide electromagnetic coupling between the first waveguide and the second waveguide, and the other port of the second waveguide is on a face perpendicular to the lateral port.

One advantage of the present invention is that it combines the effects of a bent waveguide changing the exit plane and a twist changing the polarization by carefully choosing the orientation of the second waveguide relative to the first waveguide.

The present invention also relates to a system for rotating the polarization of a polarized electromagnetic wave through a predefined angle, characterized in that it comprises a first waveguide connected to a second waveguide of a device according to claim 1 by a coupling orifice smaller than the cross-section of said first waveguide and whose geometry is adapted to provide electromagnetic coupling and in that the system includes a port in said first waveguide and a port in said second waveguide.

This invention is based on a priority application EP 00 44 0194 which is hereby incorporated by reference.

BRIEF DESCRIPTION OF THE DRAWINGS

Other features and advantages of the invention will become apparent on reading the following detailed description of various embodiments, which refers to the accompanying drawings, in which.

DETAILED DESCRIPTION OF THE INVENTION

Figure 1:
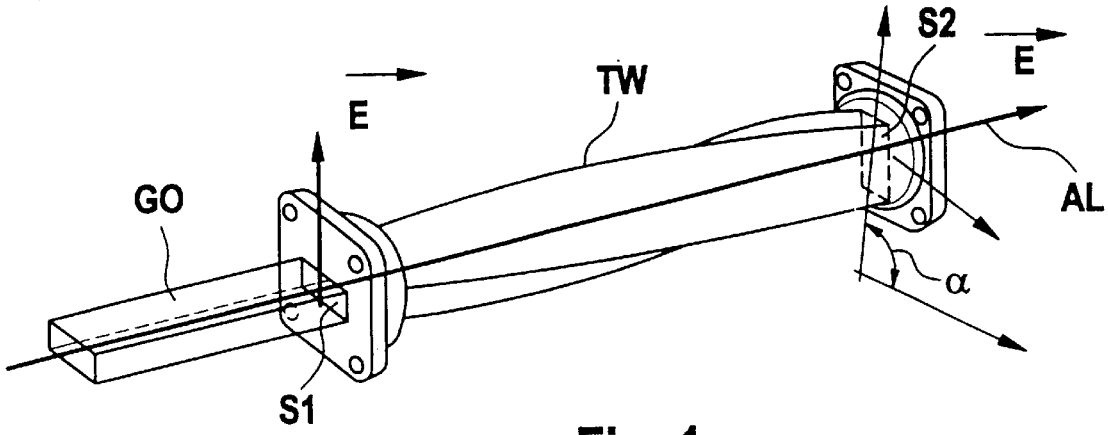
FIG. 1 shows a twist known in the art.

FIG. 1 is described above with reference to the prior art.

FIGS. 2 to 5 show systems of the invention in which the first and second waveguides are both rectangular. The invention is not restricted to this type of system, however. A system with first and second waveguides in the form of circular waveguides operating in a polarized mode and a hybrid system including both a circular waveguide operating in a polarized mode and a rectangular waveguide are also within the scope of the invention. In the above-mentioned combinations, the coupling orifice is contained within—and is smaller than—the surface of intersection of the two members of the system.

Figure 2:
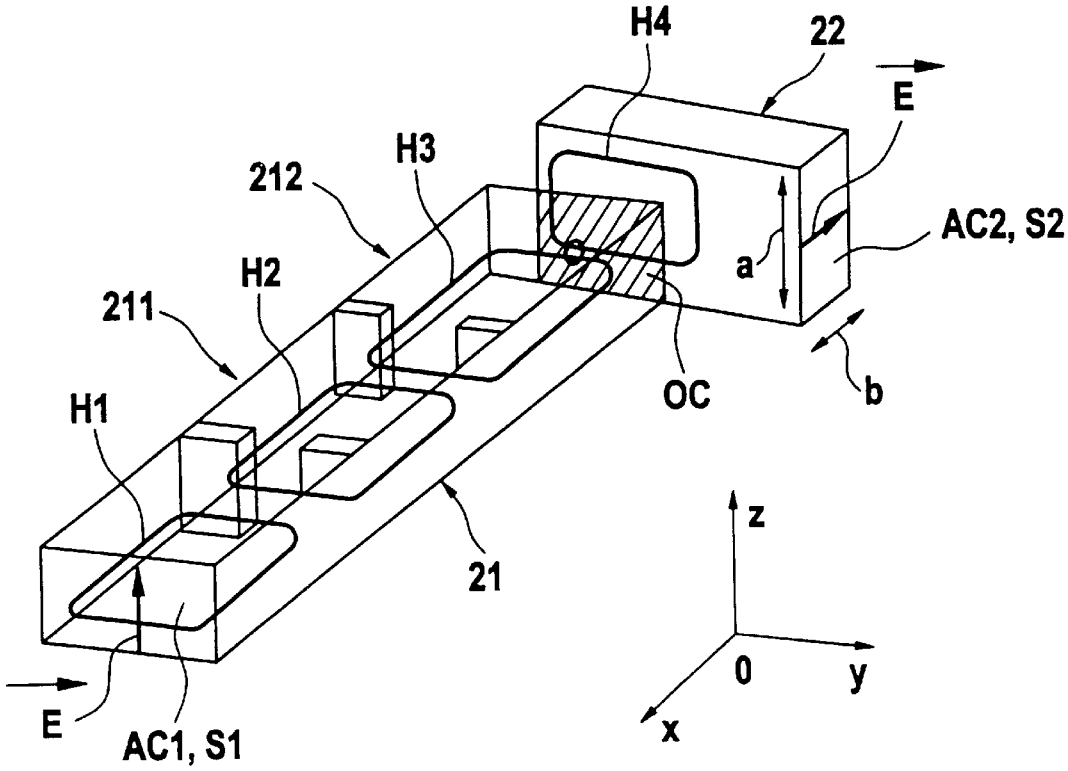
FIG. 2 shows a first embodiment of a system of the present invention and illustrates the underlying physical phenomenon.

FIG. 2 shows a first embodiment of a system of the invention and illustrates the underlying physical phenomenon. The system includes a rectangular waveguide type microwave filter 21, for example a duplexer, extended by a device 22 according to the invention for rotating the polarization of a polarized electromagnetic wave propagating in the filter 21. The spatial locations of the components in the figure are specified relative to a three-dimensional system of axes Oxyz. The waveguide filter 21 has a rectangular cross-section S1 and an entry port AC1 at the end of the filter 21 in the plane yOz. The longitudinal axis of the filter is the axis Ox. The filter 21 has an interior cavity 211, defined by an iris or a rod, and an exit cavity 212. The exit cavity 212 includes a coupling orifice OC in the plane yOz whose dimensions are less than those of the cross-section S1 of the waveguide filter. The coupling orifice is preferably rectangular. Any other shape for the coupling orifice may be feasible, such as an oblong shape, which is preferable in the case of a circular waveguide 22.

The coupling opening is preferably rectangular with a length smaller than $\lambda g/2-\lambda g$ being the wavelength inside the wave guide. The length of the coupling opening further depends on the bandwidth of the microwave filter 21. For example, at a frequency of 30 GHz, the length of the rectangular cross Section S1 may be chosen equal to 8.64 mm while the length of the coupling opening is chosen smaller than 6 mm.

The device of the invention comprises a rectangular waveguide 22 connected to the filter 21 via the coupling orifice OC. The waveguide 22 has a rectangular cross-section S2 in the plane xOz with the shorter side b along the axis Ox and the longer side a along the axis Oz. The waveguide 22 can have any length in the direction Oy, depending essentially on dimensional constraints. The rectangular waveguide 22 has a lateral port on one of the faces corresponding to the longer side of its cross-section. This lateral port coincides with and is congruent with the coupling orifice OC of the exit cavity 212. The rectangular waveguide 22 has a second port AC2 on a face perpendicular to that on which the lateral port is situated. The second port AC2 corresponds to the rectangular cross-section S2 in the plane xOz.

An electromagnetic wave characterized by its electric field E and its magnetic field H, represented by magnetic field lines H1, H2, H3, H4, propagates through the waveguide filter 21. The electric field E in the waveguide filter 21 is polarized in the direction of the axis Oz. The magnetic field lines H1, H2, H3, H4 form magnetic field loops in the plane xOy extending along the walls of the each cavity 211, 212. The cavities 211 and 212 are electromagnetically coupled. Further electromagnetic coupling occurs when the electromagnetic wave propagates through the coupling orifice OC. Moreover, because of the continuity and parallelism properties of the magnetic field lines at the coupling orifice OC, a magnetic field loop is generated in the plane yOz inside the waveguide 22. According to Maxwell's equations, the polarization of the electric field E in the waveguide 22 is in the direction of the axis Ox.

The polarization of the electric field E has therefore been rotated 90°. The exit port AC2 and the entry port AC1 of the system shown in FIG. 2 are in perpendicular planes.

This has the advantage of combining the effects of a twist and a bent waveguide; the twist rotates the polarization and the bent waveguide changes the plane of the exit port. These two effects can be combined, for example, when integrating microwave devices for convenience in connecting various microwave components. The system and the device of the invention meet these requirements within a greatly reduced overall size.

Figure 3:
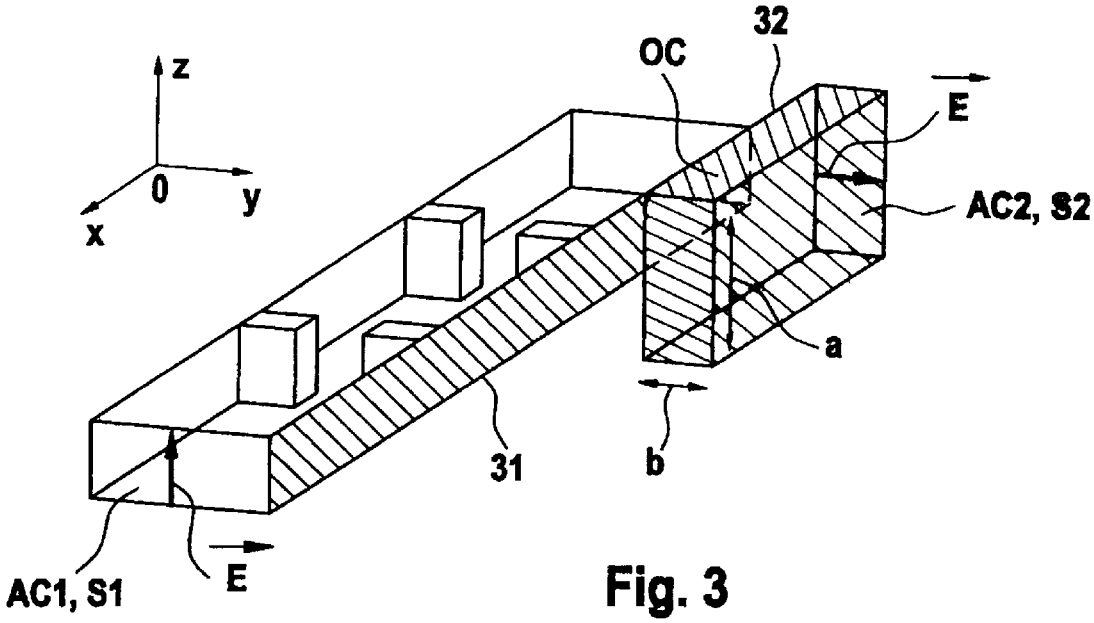
FIGS. 3 and 4 show two other embodiments of a system of the present invention.
Figure 4:
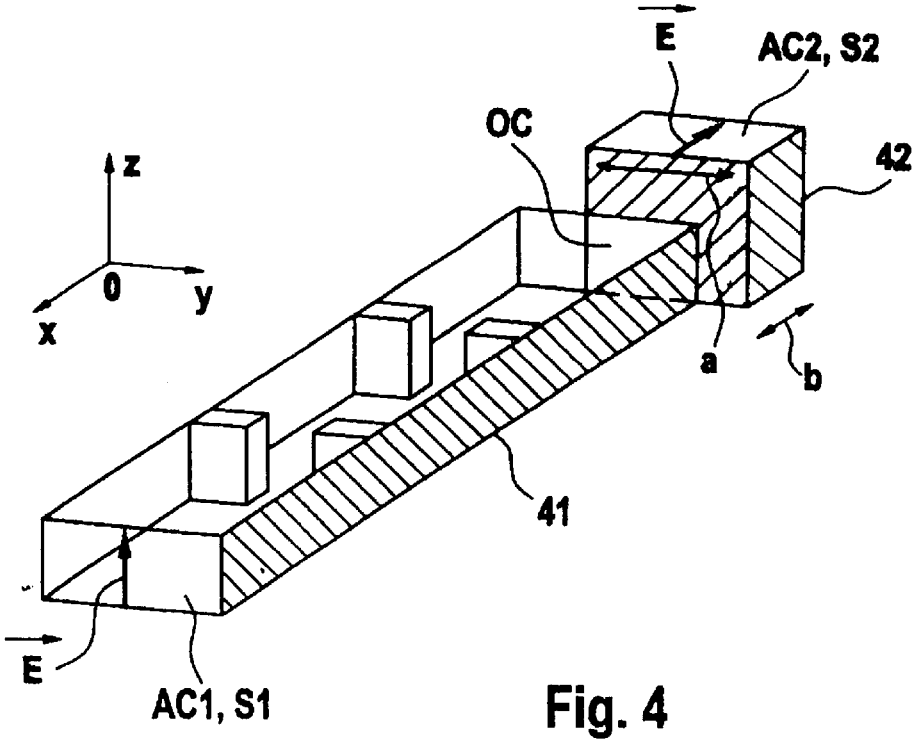
Figure 5:
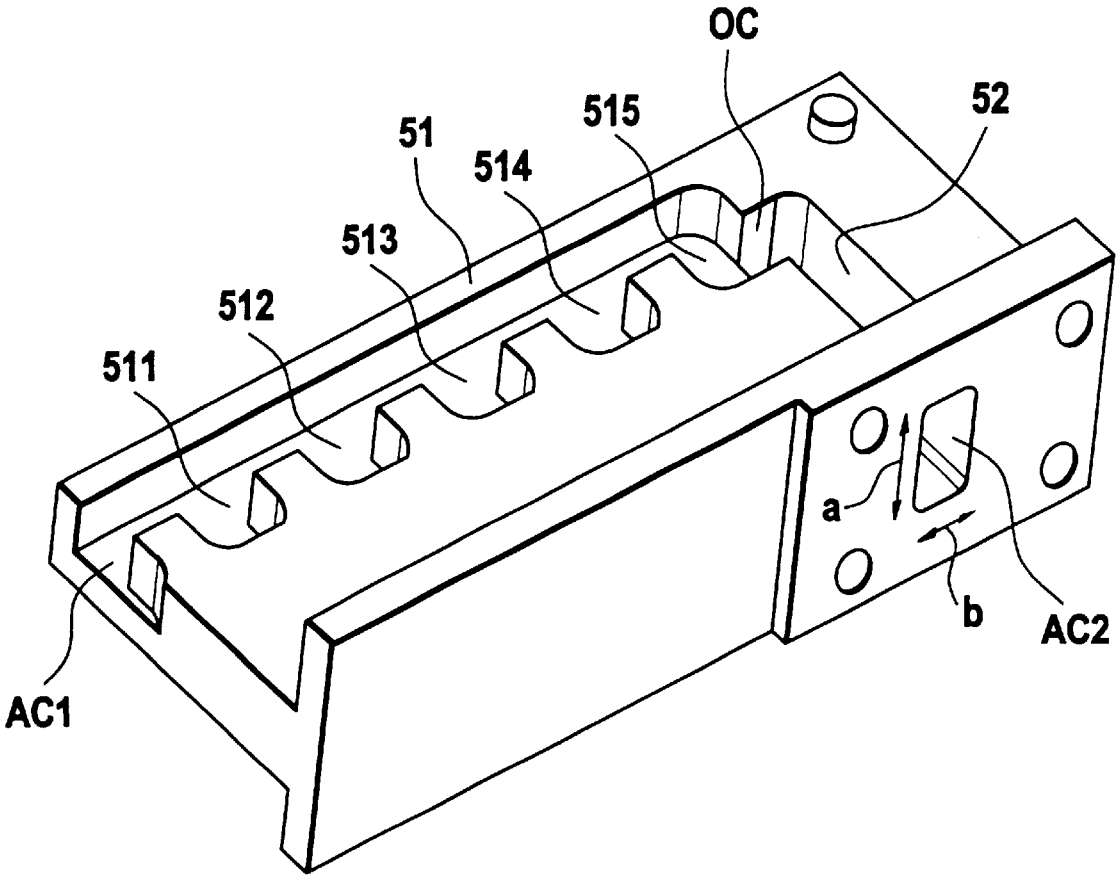
FIG. 5 is a sectional view of a machined component producing a system of the invention.
Figure 6:
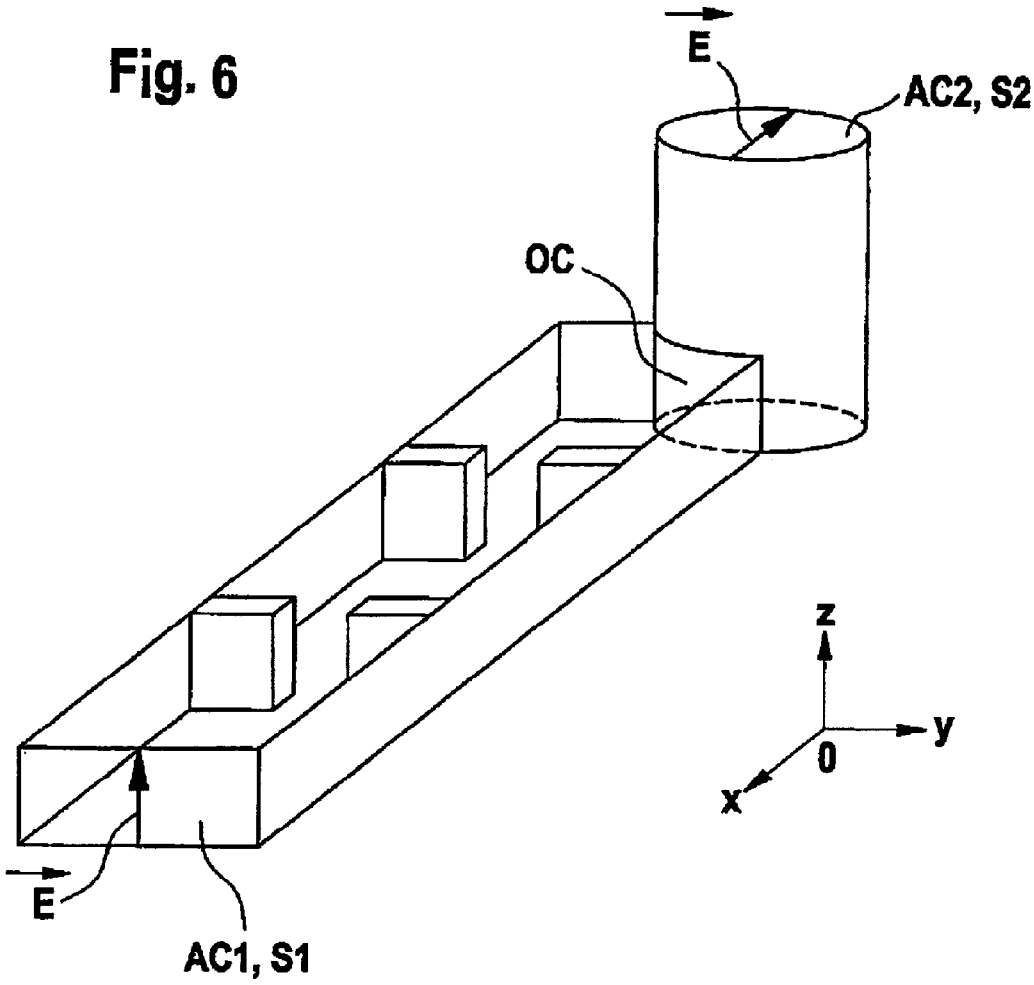
FIG. 6 shows an embodiment of a system according to the present invention in which a second waveguide is a circular waveguide.
Figure 7:
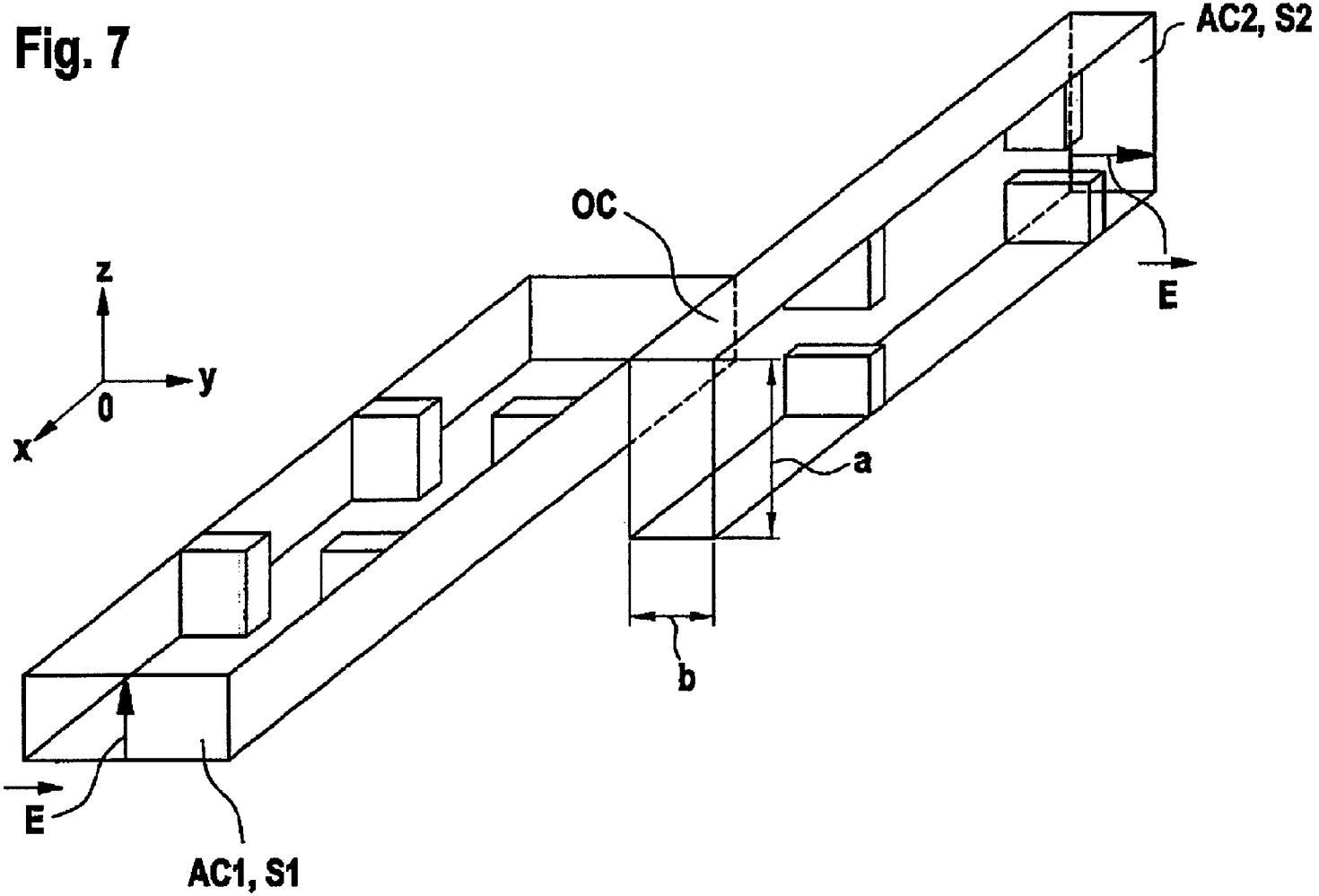
FIG. 7 is an embodiment according to a system according to the present invention in which a second waveguide is shown including a plurality of successive cavities.

The system shown in FIG. 2 and in the subsequent FIGS. 3, 4 and 5 has a microwave filter as its first member. The invention is not limited to systems including a waveguide microwave filter as the first member, however. A system including a simple waveguide as the first member and having a coupling orifice, as previously described, is also within the scope of the invention. The invention relates to rotating the polarization of an electromagnetic wave, a technical effect which, in the invention, is produced at the interface between the first member 21 and the device 22 according to the invention, consisting of a rectangular waveguide. Similarly, a circular waveguide can be used as the first member of the system.

The device of the invention can also consist of a waveguide microwave filter. It is also feasible for a first part of the transfer function of the microwave filter to be implemented in the first member of the system and a second part of the transfer function to be implemented in the extension of the waveguide 22.

In FIGS. 1 to 5, the polarization is rotated 90°. In other embodiments of the invention, other rotation angle values can be chosen.

Like FIG. 2, FIG. 3 shows a system having a rectangular waveguide type microwave filter 31 as the first member of the system connected to a waveguide 32 to rotate the polarization of a polarized electromagnetic wave propagating in the filter 31. The microwave filter has a coupling orifice OC on a lateral face corresponding to the shorter side b of the cross-section of the waveguide filter 31.

The waveguide 32 has a rectangular cross-section S2 in the plane yOz with the shorter side b along the axis Oy and the longer side a along the axis Oz. The rectangular waveguide 32 has a lateral port on one face corresponding the longer side of the cross-section of the waveguide 32 and coinciding with the coupling orifice OC and a port AC2 on a face perpendicular to that on which the lateral port is situated and in the plane yOz. In this configuration, and using the same reasoning as for the previous figure, the system rotates the polarization of the electric field of a polarized wave passing through the system. Here the entry and exit ports are coplanar.

Like FIG. 2, FIG. 4 shows a system including a rectangular waveguide type microwave filter 41 connected to a rectangular waveguide 42. The microwave filter 41 has a coupling orifice OC at one end.

The waveguide 42 has a rectangular cross-section S2 in the plane xOy with the shorter side b in the direction of the axis Ox and the longer side a in the direction of the axis Oy. The rectangular waveguide 42 has a lateral port on a face corresponding to the longer side a of the cross-section of the waveguide 42 and coincident with the coupling orifice OC, together with a port AC2 on a face perpendicular to that on which the lateral port is situated and in the plane yOx.

In this configuration, and using the same reasoning as for the previous figure, the system produces the same effect on the polarized wave passing through the system as a waveguide bent at 90°, but does so within a small overall size. The entry port AC1 and the exit port AC2 of the system are in perpendicular planes.

FIG. 5 shows a partial cross-section of a machined component having the features of the system according to the invention shown diagrammatically in FIG. 2. The cross-section shows the first member of the system consisting of a waveguide filter 51 which has multiple internal cavities 511, . . . , 514 and an exit cavity 515. A coupling orifice with dimensions less than those of the cross-section of the waveguide filter provides the interface between the waveguide filter 51 and a rectangular waveguide 52 according to the invention. The coupling orifice OC opens onto a face of the waveguide 52 corresponding to the longer side a of the cross-section of the waveguide 52. The component could be cast instead of being machined.

What is claimed is:

1. A device for rotating through a predefined angle the polarization of a polarized electro-magnetic wave propagating in a first waveguide having a port, said device comprising:

a second waveguide having a lateral port and having a coupling orifice on a face of said second waveguide perpendicular to said lateral port, wherein said polarized electro-magnetic wave propagates between said port of said first waveguide and said lateral port of said second waveguide via said coupling orifice that is smaller than the cross-section of said first waveguide, and wherein the geometry of said coupling orifice provides electro-magnetic coupling between said first waveguide and said second waveguide.

2. The device according to claim 1, characterized in that said coupling orifice has an area less than the area of the cross-section of said first waveguide and in that said port of said first waveguide, said lateral port of said second waveguide and said coupling orifice are geometrically congruent.

3. A device for rotating through a predefined angle the polarization of a polarized electro-magnetic wave propagating in a first waveguide, said device being characterized in that it comprises a second waveguide having a lateral port, said polarized electro-magnetic wave propagates between a port of said first waveguide and said lateral port of said second waveguide via a coupling orifice that is smaller than the cross-section of said first waveguide and whose geometry is adapted to provide electro-magnetic coupling between said first waveguide and said second waveguide, and the other port of said second waveguide is on a face perpendicular to said lateral port, wherein said first waveguide is a rectangular waveguide type microwave filter including a plurality of successive cavities and said coupling orifice opens directly into an end cavity of said first waveguide.

4. The device according to claim 1, characterized in that said second waveguide is a rectangular waveguide having said lateral port on one of the faces corresponding to the longer side of the cross-section of said second waveguide.

5. The device according to claim 1, characterized in that said second waveguide is a circular waveguide operating in a polarized mode and said coupling orifice is in the surface at which said first waveguide and said circular second waveguide intersect.

6. A device for rotating through a predefined angle the polarization of a polarized electro-magnetic wave propagating in a first waveguide, said device being characterized in that it comprises a second waveguide having a lateral port, said polarized electro-magnetic wave propagates between a port of said first waveguide and said lateral port of said second waveguide via a coupling orifice that is smaller than the cross-section of said first waveguide and whose geometry is adapted to provide electro-magnetic coupling between said first waveguide and said second waveguide, and the other port of said second waveguide is on a face perpendicular to said lateral port, wherein said second waveguide is also a rectangular waveguide type microwave filter including a plurality of successive cavities and said coupling orifice opens directly into an end cavity of said second waveguide.

7. The system for rotating the polarization of a polarized electro-magnetic wave through a predefined angle, characterized in that it comprises a first waveguide connected to a second waveguide of a device according to claim 1 by a coupling orifice smaller than the cross-section of said first waveguide and whose geometry is adapted to provide electro-magnetic coupling and in that the system includes a port in said first waveguide and a port in said second waveguide.

8. The system according to claim 7, characterized in that the plane of said port in said first waveguide and the plane of said port in said second waveguide are perpendicular.

9. The device according to claim 1, wherein the coupling orifice is rectangular with a length smaller than $\lambda g/2$, $\lambda g$ being a wavelength inside at least one of said first waveguide and said second waveguide.

10. The device according to claim 1, wherein efficacy of said electromagnetic coupling between the first and second waveguides is controlled by at least one of the geometry and size of said coupling orifice.

* * * * *